US006269879B1

(12) United States Patent
Boyd

(10) Patent No.: US 6,269,879 B1
(45) Date of Patent: Aug. 7, 2001

(54) SLEEVE LINER FOR WIRELINE ENTRY SUB ASSEMBLY

(76) Inventor: Harper Boyd, 714 Newton St., Lake Charles, LA (US) 70607-7474

( * ) Notice: Subject to any disclaimer, the term of this patent is extended or adjusted under 35 U.S.C. 154(b) by 0 days.

(21) Appl. No.: 09/528,395

(22) Filed: Mar. 20, 2000

(51) Int. Cl.[7] ..... E21B 17/10

(52) U.S. Cl. ..... 166/242.5; 166/75.11; 166/242.6

(58) Field of Search ..... 166/65.1, 75.11, 166/77.1, 242.1, 242.2, 242.3, 242.5, 242.6, 385

(56) References Cited

U.S. PATENT DOCUMENTS

| | | | | |
|---|---|---|---|---|
| Re. 33,150 | * | 1/1990 | Boyd | 166/242.5 |
| 2,851,112 | * | 9/1958 | Buck | 166/242.1 X |
| 4,062,551 | * | 12/1977 | Base | 166/242.5 |
| 4,388,969 | * | 6/1983 | Marshall et al. | 166/242.5 |
| 4,524,834 | * | 6/1985 | Barron et al. | 166/385 |
| 4,848,480 | * | 7/1989 | Titchener et al. | 166/385 |
| 4,913,227 | * | 4/1990 | Wittrisch | 166/385 |
| 5,284,210 | * | 2/1994 | Helms et al. | 166/385 |
| 5,996,712 | * | 12/1999 | Boyd | 166/242.7 X |

* cited by examiner

*Primary Examiner*—George Suchfield
(74) *Attorney, Agent, or Firm*—Garvey, Smith, Nehrbass & Doody, LLC

(57) ABSTRACT

A side entry tool having a lower end portion for receiving a saver sub thereon. There is further provided a sleeve portion positioned in the lower end of the side entry tool having an outside diameter smaller than the inside diameter of the tool body; the sleeve would have undergone heat treatment to a certain rockwell hardness so that because of the smaller diameter of the sleeve, any contact of the wireline with the tool body would make contact with the hardened sleeve, which could take the contact without a groove or cut being formed in the sleeve. The sleeve would be held in place with a set screw at its lower end to prevent it from rotating. In the event the sleeve indicates wireline wear, the set screw would be loosened and the sleeve would be rotated so that the wireline would make contact with a non-affected portion of the sleeve. Additionally, a sleeve would be pressed into the interior wall of the saver sub, to a certain rockwell hardness, so that the saver sub would likewise have the ability to take excessive wireline wear without having to be replaced on a regular basis.

15 Claims, 3 Drawing Sheets

SLEEVE LINER FOR WIRELINE ENTRY SUB ASSEMBLY

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to wireline operations in the recovery of oil and gas. More particularly, the present invention relates to a protective liner in a wireline sub assembly system for eliminating excessive wear on the interior wall of the assembly portion or a saver sub portion of the assembly.

2. General Background of the Invention

In conducting wireline operations, many types of tools are positioned on the lower end of a wireline, which is a steel cable or the like, lowered into the well bore in order to undertake certain tests downhole. Because in the past there has been difficulties in undertaking wireline work with the potential hazard of blowouts in the well, there has been developed and patented by the present inventor, a side entry sub assembly which is patented under U.S. Pat. No. 4,681,162 and reissued under U.S. Pat. No. RE 33,150. This patented device, which is placed below the top drive on the rig floor, includes a side entry portion which enables the wireline to extend through the side entry passage and into the main passage and downward into the drill string. One of the problems that has been confronted with using the entry assembly by itself is that as the wireline extends down through the angulated passage in the tool, at the point that it exits the bottom of the wireline assembly into the borehole, it tends to make contact with the inner wall of the assembly. As the wireline is moved up and down through the borehole, it would literally wear or cut into the wall. Therefore, as part of the patented combination, the wireline assembly includes a lower sub having a male end portion, which is threadable into the lower end of the wireline assembly, so that the wireline makes contact with the upper end of the sub, and if any damage to the interior is done, it is done to the interior wall of the sub, a product which is inexpensive and can be replaced quite easily.

However, over the years, the side entry sub assembly has experienced problems with excessive wireline wear in the lower end of the side entry tool and the saver sub. Therefore, the applicant has devised a system whereby the side entry tool itself and the saver sub can be fabricated or modified in order to avoid excessive wireline wear on the assembly and the sub which would result in savings by eliminating damage to the tool body and by eliminating the need for the replacement of subs on a regular basis.

BRIEF SUMMARY OF THE INVENTION

The apparatus of the present invention solves the problems in a simple and straightforward manner. What is provided is a side entry tool having a lower end portion for receiving a saver sub thereon. There is further provided a sleeve portion positioned in the lower end of the side entry tool having an outside diameter smaller than the inside diameter of the tool body; the sleeve would have undergone heat treatment to a certain rockwell hardness. Because of the smaller diameter of the sleeve, any contact of the wireline with the tool body would make contact with the hardened sleeve, which could take the contact without a groove or cut being formed in the sleeve. The sleeve would be held in place with a set screw at its lower end to prevent it from rotating. In the event the sleeve indicates wireline wear, the set screw would be loosened and the sleeve would be rotated so that the wireline would make contact with a non-affected portion of the sleeve. Additionally, a sleeve could be pressed into the interior wall of the saver sub, to a certain rockwell hardness, so that the saver sub would likewise have the ability to take excessive wireline wear without having to be replaced on a regular basis.

Therefore, it is a principal object of the present invention to provide a system for protecting the interior passage of the side entry tool by providing a surface on a portion of the interior passage that can receive excessive wireline wear without cutting into the surface;

It is a further object of the present invention to adapt existing side entry tools with a rockwell hardened sleeve on the lower end of the tool, the sleeve being of such a diameter so that any contact of the wireline with the tool would make contact with the hardened sleeve which could receive excessive wear without cutting;

It is a further object of the present invention to provide a side entry tool system which may include a saver sub having a rockwell hardened sleeve pressed into the interior passage of the sub so that wireline wear on the sub would be borne by the hardened sleeve and would reduce the excessive wear on the sub eliminating regular replacement of the sub in the system;

It is a further object of the present invention to provide a side entry tool wherein a hardened sleeve which has been provided in the lower portion of the tool has the ability to be rotated within the tool so as to allow wear to occur along different points of the sleeve.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
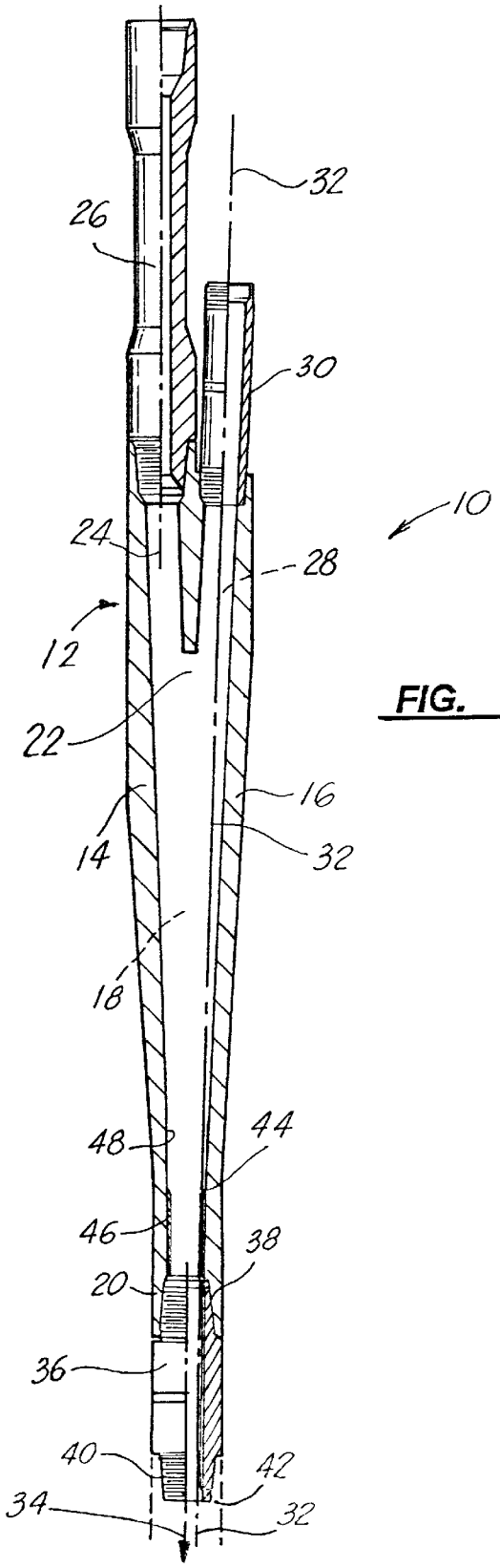
FIG. 1 illustrates an overall view of the side entry tool system of the present invention with a saver sub secured thereto.

FIGS. 1–5 illustrate the preferred embodiment of the system of the present invention by the numeral 10. As seen in the Figures, particularly FIG. 1, there is illustrated a typical side entry tool 12 of the type disclosed in U.S. Pat. No. RE 33,150, or modifications thereof, the side entry tool having a principal tool body 14 with a circular outer wall 16, the tool body 14 having a principal passage portion 18 extending from the lower end 20 of the tool body to an upper point 22 of the tool body as illustrated in FIG. 1. There is further illustrated the passage extending into a first principal passage 24 which would be threaded onto a pipe or upper sub member 26 so as to support the tool as it is positioned within the drill string above the rig floor. There is formed a second passage 28 which has a sub member 30 secured therethrough wherein a wireline (line 32) extends therethrough downward into the principal passage 18 of the tool and down into the borehole in the direction of arrow 34. It should be noted further that at the lower end 20 of the tool there is illustrated a saver sub 36 which has an upper male portion 38 threadably secured to the lower end 20 of the tool and a lower male portion 40 which would be threadably engaged to a section of drill pipe 42 shown in phantom view in FIG. 1.

It should be noted in FIG. 1 that as wireline 32 extends downward into bore 18, it reaches a point at 44 where there is illustrated a sleeve member 46 which has been placed around the interior surface 48 of the wall of bore 18. This sleeve portion 46 would in the preferred embodiment comprise a sleeve being approximately 14 inches long with an upper end about 3½ inches plus or minus inside diameter at its upper end tapering to approximately 3 inches plus or minus of the inside diameter at the lower end of the sleeve 46. Sleeve 46 would have been heat treated to approximately 50C rockwell hardness, or the sleeve would be hard banded inside by applying hard banding in a professional manner. As seen visually in FIG. 1, the sleeve 46 extends outward from the wall 48 of the tool wall 14 so that when the wireline 32 extends downward and makes contact at point 44, the wireline is making contact with the hardened sleeve 46 and not with the surface 48 of tool 12.

Figure 3:
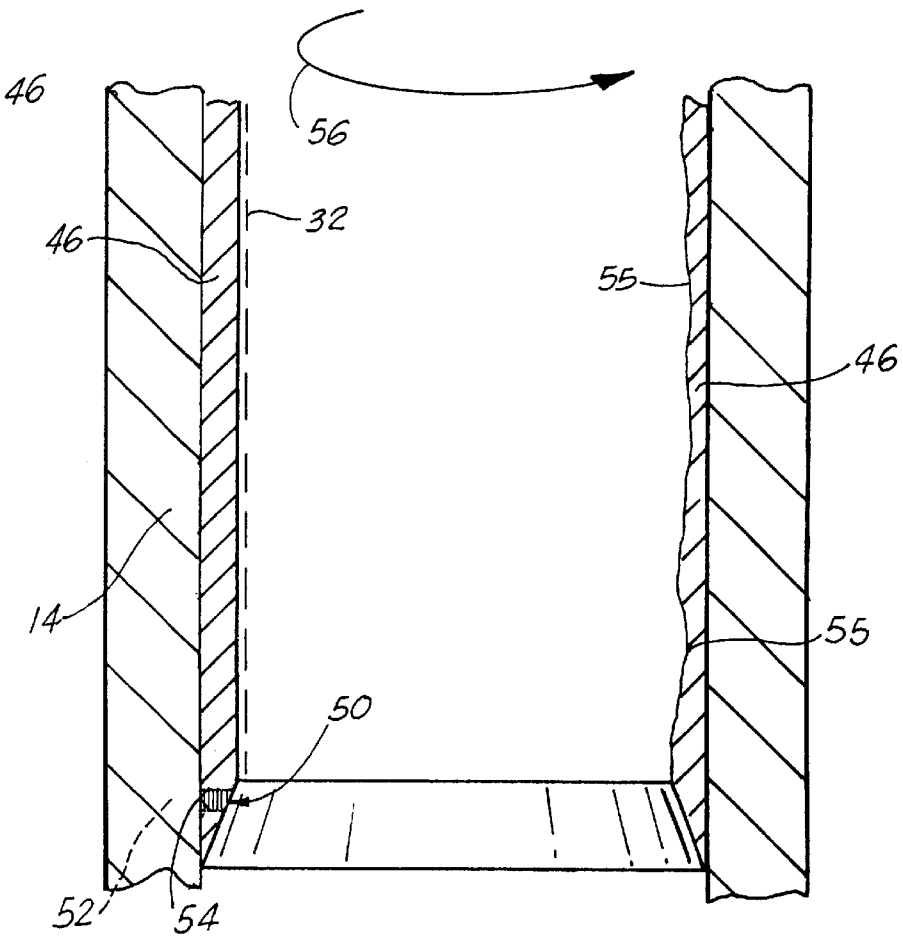
FIGS. 2 and 3 illustrate cross section views of the sleeve portion in the side entry tool with the ability to be rotated within the passage of the tool to allow additional wear on the hardened sleeve.
Figure 2:
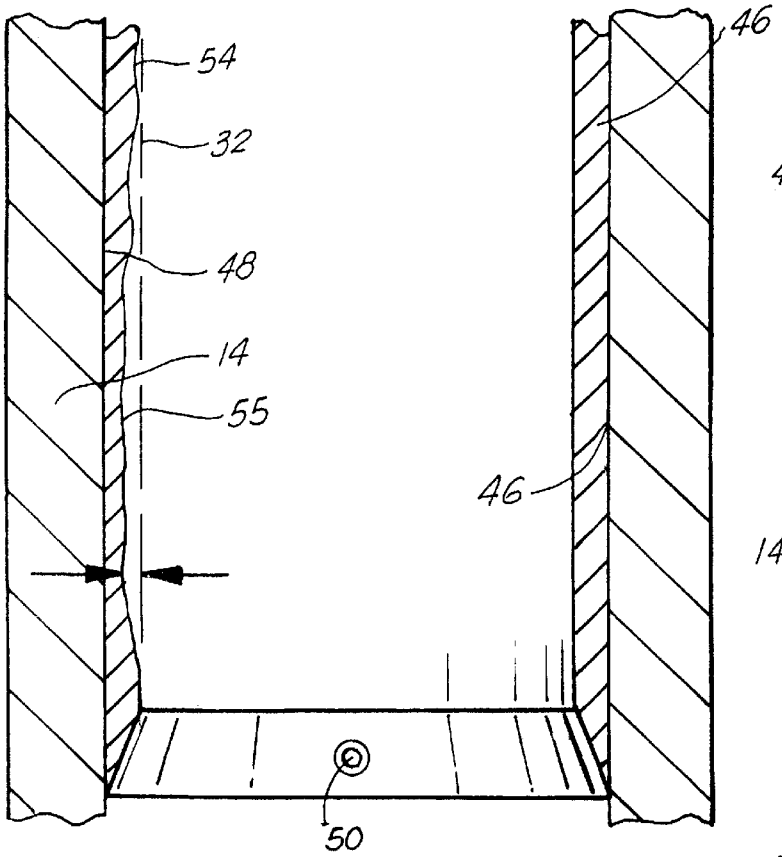

Reference is made to FIGS. 2 and 3 where there is illustrated again in isolated view the wall 16 of the tool 12, with the sleeve 46 secured therein as was discussed in FIG. 1. As seen clearly, the sleeve 46 is positioned against the interior surface 48 of wall 16, and in FIGS. 2 and 3, the sleeve 46 is held in place against wall 16 of the tool 12 by a set screw 50 which is threaded through a port 52 through sleeve 46 to press, at point 54, against the wall 16 of the tool 14. This would eliminate any possible rotation of the sleeve 46 during the use of the tool. The set screw 50, as seen in FIGS. 2 and 3 has yet another purpose. For example, in FIG. 2 there is seen the wireline 32 having made contact with the sleeve 46 and which shows a worn surface 55 at points all along the sleeve 46. When such wearing would occur on the sleeve 46, reference is made to FIG. 3. At this point, set screw 50 would have been loosened, and the sleeve 46 would be rotated for example, in the direction of arrow ,56 which would allow the unworn surface of the sleeve 46 to have been rotated in the position, as seen in FIG. 3, so that as the wireline 32 makes contact with the wall of the sleeve 46, it is making contact with the portion that has not been worn. The worn portion 55 has been rotated approximately 180 degrees so that the fresh unworn surface may be used. Such ability to rotate the sleeve 46 within the lower end 20 of the tool 12 is beneficial in that it would allow greater use of the sleeve 46 with a single tool and eliminate the need to replace the sleeve.

Figure 4:
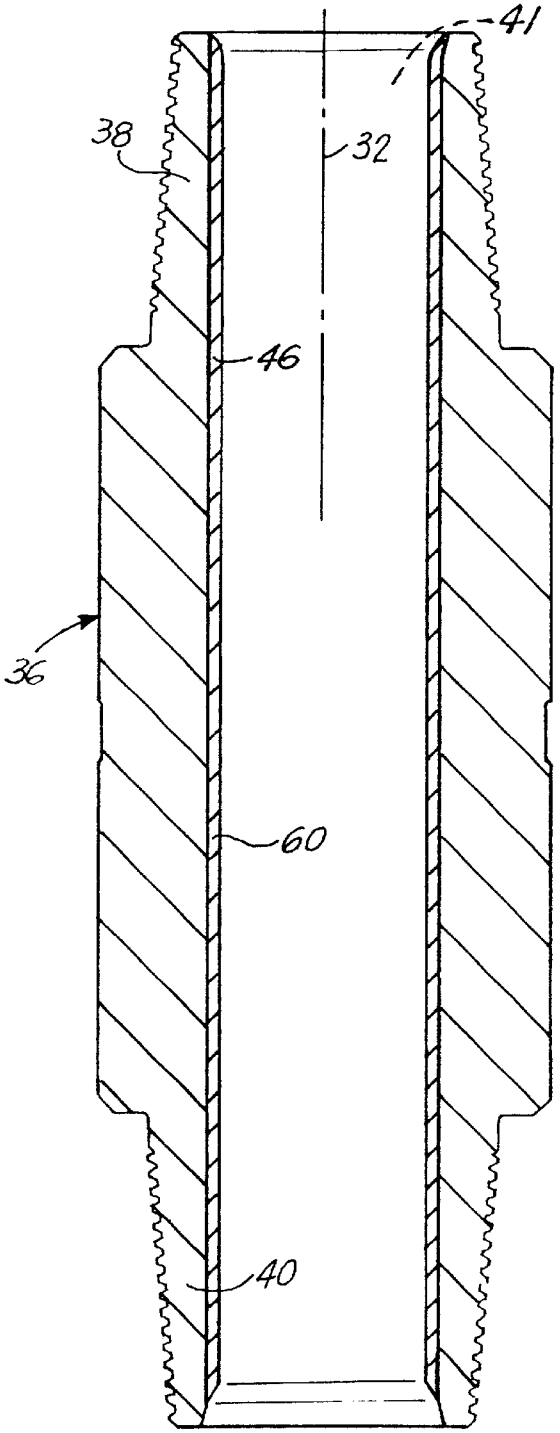
FIG. 4 illustrates a cross section view of the saver sub with the hardened sleeve in the preferred embodiment of the present invention.

Reference is now made to FIG. 4 where there is illustrated the saver sub 36 as was described in FIG. 1. As illustrated, again saver sub 36 has an upper threadable portion 38 and a lower threadable portion 40. Saver sub 36 also includes an interior passage 41 for allowing a wireline or the like 32 to extend therethrough as illustrated in FIG. 1. As seen in FIG. 4, in this Figure a sleeve 46, again as was discussed earlier, has been positioned within the interior of the passage 41 of saver sub 36 and would have, in the preferred embodiment, been heat treated, again to around 50C rockwell hardness, and would have been pressed into the interior wall of the saver sub 36 so as to form a permanent interior lining 60 of the sleeve 46 therein.

Figure 5:
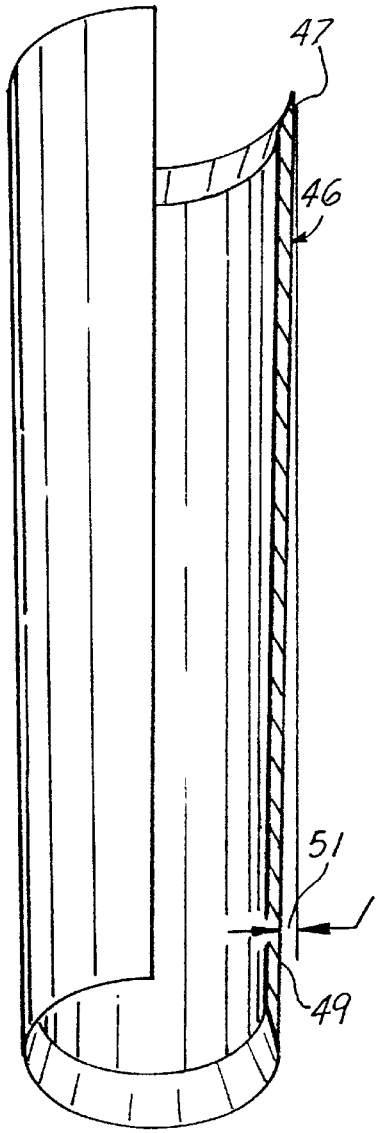
FIG. 5 illustrates an isolated view of the sleeve portion of the present invention that would be positioned within the interior of the saver sub attached to the side entry tool itself.

As seen in FIG. 5, there is illustrated the sleeve 46 within saver sub 36, with sleeve 46 tapering over its length from point 47 to lower point 49 of a certain quantity as illustrated by arrows 51. This is important in that as the wireline 32 extends downward through the passageway 41 of the saver sub 36, it would tend to make contact with the sleeve 46 within saver sub 36 and the tapering of the sleeve 46 at point 49 would allow that contact of wireline 32 would be greater at that point where the tapering has occurred.

In the preferred embodiment, the sleeve within the saver sub would be 3 inches in the interior diameter and would be 3.5 inches in the outer diameter and would be approximately 17 inches in length plus or minus a certain amount. The hardened sleeve in the lower portion of the tool 12 would be 3 inches in the interior diameter and 3.75 inches in the outer diameter and would be approximately 14 plus or minus inches in length. Again, this thickness on the lower portion of the sleeve would allow more hardened steel at that point where the wear by the wireline is greater on that portion of the tool.

Although it may be intended that side entry tools could be manufactured with such a sleeve as part of the tool body and as part of the saver sub body, it is foreseen that any side entry of other type of entry tool which is currently on the market may be adapted with a sleeve on its lower end by simply mechanically placing the sleeve into the passageway of the tool and securing it in place with set screws and any existing saver subs could be adapted with an interior sleeve that could be pressed into the interior wall of the passage. Therefore, this particular system of eliminating wear on side entry tools and saver subs could be an adaptable system to existing tools.

The foregoing embodiments are presented by way of example only; the scope of the present invention is to be limited only by the following claims.

What is claimed is:

1. An improved wireline entry apparatus, comprising:

a. a tool body having a first lower end and a second upper end;

b. a principal bore through the tool body from the upper to the lower end;

c. a portion of the tool body having a second bore intersecting into the principal bore for allowing a wireline to be inserted through the second bore and extend from the lower end of the tool body; and d. a portion of the lower end of the bore of the tool body having a wall portion of hardened material so as to eliminate wear on the lower end of the tool body as the wireline is run through the bore in the tool body.

2. The apparatus in claim 1, wherein the upper end of the tool body threads unto a threaded member above the tool body.

3. The apparatus in claim 1, wherein the lower end of the tool body threads onto a tubular member below the tool body.

4. The apparatus in claim 1 wherein the wall portion on the lower end of the bore comprises a metal sleeve hardened to a specific Rockwell hardness positioned within and against the wall of the lower end of the tool body.

5. The apparatus in claim 4, wherein the metal sleeve is able to be rotated within the bore so as to allow different points along the sleeve to make contact with the wireline.

6. The apparatus in claim 4, wherein the diameter of the metal sleeve is less than the diameter of the bore of tool body.

7. The apparatus in claim 1, further comprising a saver sub threadably secured to the lower end of the tool body, the saver sub further comprising a hardened metal sleeve within the bore of the saver sub to withstand cutting when contact is made with the wireline.

8. An improved wireline entry apparatus, comprising:

a. a tool body having a first lower end and a second upper end;

b. a principal bore through the tool body from the upper to the lower end;

c. a portion of the tool body having a second bore intersecting into the principal bore for allowing a wireline to be inserted through the second bore and extend from the lower end of the tool body; and d. a portion of the lower end of the bore of the tool body further comprising a metal sleeve hardened to a specific Rockwell hardness positioned within and against the wall of the lower end of the tool body for resisting cutting when the wireline makes contact with the metal sleeve.

9. The apparatus in claim 8, wherein the metal sleeve is able to be unsecured from the wall of the tool body in order to be rotated within the bore so as to allow different points along the sleeve to make contact with the wireline.

10. The apparatus in claim 8, wherein the diameter of the metal sleeve is less than the diameter of the bore of tool body so that the wireline makes contact with the sleeve instead of the tool body wall.

11. The apparatus in claim 8, further comprising a saver sub threadedly secured to the lower end of the tool body, the saver sub further comprising a hardened metal sleeve within the bore of the saver sub to withstand cutting when contact is made with the wireline.

12. An improved wireline entry apparatus, comprising:

a. a tool body having a first lower end and a second upper end;

b. a principal bore through the tool body from the upper to the lower end;

c. a portion of the tool body having a second bore intersecting into the principal bore for allowing a wireline to be inserted through the second bore and extend from the lower end of the tool body; and d. a saver sub threadably secured to the lower end of the tool body, the saver sub further comprising a hardened metal sleeve within the bore of the saver sub to withstand cutting when contact is made with the wireline.

13. The apparatus in claim 12, wherein a portion of the lower end of the bore of the tool body further comprises a metal sleeve hardened to a specific Rockwell hardness positioned within and against the wall of the lower end of the tool body for resisting cutting when the wireline makes contact with the metal sleeve.

14. The apparatus in claim 12, wherein the metal sleeve within the saver sub is hardened to at least 50 Rockwell hardness.

15. The apparatus in claim 13, wherein the metal sleeve within the lower end of the tool body is hardened to at least 50 Rockwell hardness.

* * * * *

US006269879C1

(12) EX PARTE REEXAMINATION CERTIFICATE (5042nd)

United States Patent

Boyd

(10) Number: US 6,269,879 C1

(45) Certificate Issued: Dec. 14, 2004

(54) SLEEVE LINER FOR WIRELINE ENTRY SUB ASSEMBLY

(75) Inventor: Harper Boyd, Lake Charles, LA (US)

(73) Assignee: Boyd's Bit Services, Inc., Lake Charles, LA (US)

Reexamination Request:
No. 90/006,342, Aug. 1, 2002

Reexamination Certificate for:

| | |
|---|---|
| Patent No.: | **6,269,879** |
| Issued: | **Aug. 7, 2001** |
| Appl. No.: | **09/528,395** |
| Filed: | **Mar. 20, 2000** |

(51) Int. Cl.[7] ..... E21B 17/10

(52) U.S. Cl. ..... 166/242.5; 166/75.11; 166/242.6

(56) References Cited

U.S. PATENT DOCUMENTS

| | | | |
|---|---|---|---|
| 1,446,789 | A | 2/1923 | Dodd |
| 4,103,748 | A | 8/1978 | Arnold |
| RE33,150 | E | 1/1990 | Boyd |
| 5,284,210 | A | 2/1994 | Helms et al. |
| 5,332,049 | A | 7/1994 | Tew |
| 5,813,465 | A | 9/1998 | Terrell et al. |

OTHER PUBLICATIONS

Machinery's Handbook; Oberg, Jones, and Horton; 21st Ed., 1981; pp. 2122–2123, 2128–2131, 2140–2141.

*Primary Examiner*—William P. Neuder

(57) ABSTRACT

A side entry tool having a lower end portion for receiving a saver sub thereon. There is further provided a sleeve portion positioned in the lower end of the side entry tool having an outside diameter smaller than the inside diameter of the tool body; the sleeve would have undergone heat treatment to a certain rockwell hardness so that because of the smaller diameter of the sleeve, any contact of the wireline with the tool body would make contact with the hardened sleeve, which could take the contact without a groove or cut being formed in the sleeve. The sleeve would be held in place with a set screw at its lower end to prevent it from rotating. In the event the sleeve indicates wireline wear, the set screw would be loosened and the sleeve would be rotated so that the wireline would make contact with a non-affected portion of the sleeve. Additionally, a sleeve would be pressed into the interior wall of the saver sub, to a certain rockwell hardness, so that the saver sub would likewise have the ability to take excessive wireline wear without having to be replaced on a regular basis.

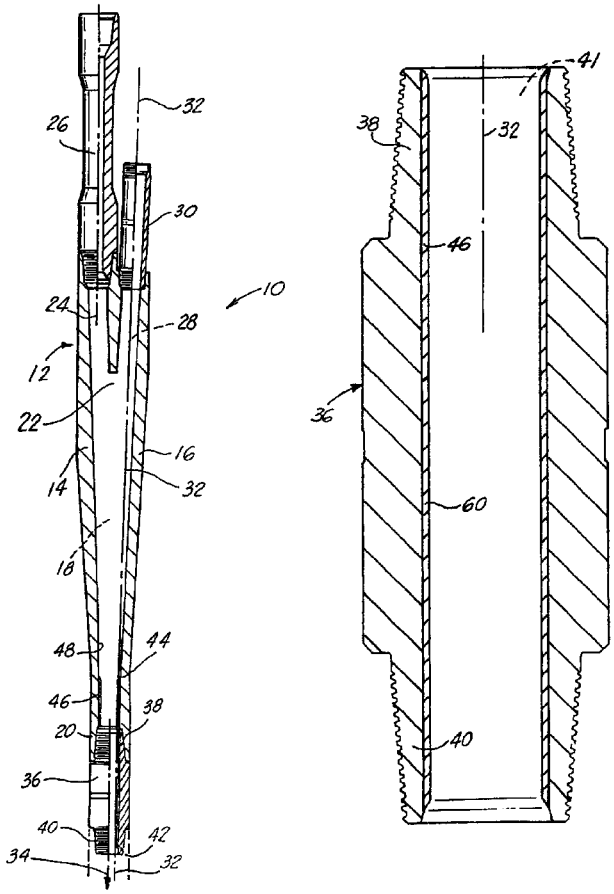

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 6, 7, 10 and 11 are cancelled.

Claims 1, 4, 5, 8, 9 and 12–15 are determined to be patentable as amended.

Claims 2 and 3, dependent on an amended claim, are determined to be patentable.

1. [An improved] *A* wireline entry apparatus, comprising:

a. a tool body having a [first] lower end and [a second] *an* upper end;

b. a principal bore through the tool body from the upper to the lower end;

c. a portion of the tool body having a second bore intersecting into the principal bore for allowing a wireline to be inserted through the second bore *into the principal bore* and [extend] *to be extended* from the lower end of the tool body; and d. a portion of the *principal bore at the* lower end [of the bore] of the tool body having a wall portion of hardened material [so as] *disposed* to [eliminate] *receive wireline* wear on the lower end of the tool body as the wireline is run through the [bore] *second and principal bores* in the tool body, *the wall portion having a varying hardened material thickness profile, the profile selected so as to prolong receipt of wireline wear by the wall portion as the wireline is run through the second and principal bores.*

4. The apparatus in claim 1 wherein the wall portion on the lower end [of the bore] comprises a metal sleeve hardened to a [specific] *preselected* Rockwell hardness, *the sleeve* positioned within and against the wall [of the lower end of the tool body] *portion.*

5. The apparatus in claim 4, wherein the metal sleeve is able to be rotated within the *principal* bore so as to allow different points along the sleeve to make contact with the wireline.

8. [An improved] *A* wireline entry apparatus, comprising:

a. a tool body having a [first] lower end and [a second] *an* upper end;

b. a principal bore through the tool body from the upper to the lower end;

c. a portion of the tool body having a second bore intersecting into the principal bore for allowing a wireline to be inserted through the second bore *into the principal bore* and [extend] *to be extended* from the lower end of the tool body; and d. a *wall* portion of the *principal bore at the* lower end [of the bore] of the tool body, *the wall portion* further comprising a metal sleeve, *the metal sleeve* hardened to a [specific] *preselected* Rockwell hardness [positioned] *and secured* within and against the wall [of the lower end of the tool body for resisting cutting when the wireline makes contact with] *portion so as to receive wireline wear as the wireline is run through second and principal bores,* the metal sleeve *having a varying wall thickness profile, the profile selected so as to prolong receipt of wireline wear by the metal sleeve.*

9. The apparatus in claim 8, wherein the metal sleeve is able to be unsecured from the wall [of the tool body] *portion* in order to be rotated [within the bore] so as to allow, *when re-secured to the wall portion,* different points along the sleeve to make contact with the wireline.

12. [An improved] *A* wireline entry apparatus, comprising:

a. a tool body having a [first] lower end and [a second] *an* upper end;

b. a principal bore through the tool body from the upper to the lower end;

c. a portion of the tool body having a second bore intersecting into the principal bore for allowing a wireline to be inserted through the second bore *into the principal bore* and [extend] *to be extended* from the lower end of the tool body; and d. a saver sub threadably secured to the lower end of the tool body, *the saver sub having a sub bore therethrough,* the saver sub further comprising a hardened metal sleeve within the *sub* bore [of the saver sub to withstand cutting when contact is made with the wireline], *the metal sleeve disposed to receive wireline wear as the wireline is run through the second and principal bores, the metal sleeve having a varying wall thickness profile, the profile selected so as to prolong receipt of wireline wear by the metal sleeve.*

13. The apparatus in claim 12, wherein a *wall* portion of the *principal bore at the* lower end [of the bore] of the tool body, *the wall portion* further [comprises] *comprising a tool body* a metal sleeve, *the tool body metal sleeve* hardened to a [specific] *preselected* Rockwell hardness [positioned] *and secured* within and against the wall [of the lower end of the tool body for resisting cutting when the wireline makes contact with the metal sleeve] *portion so as also to receive wireline wear as the wireline is run through the second and principal bores.*

14. The apparatus in claim 12, wherein the metal sleeve within the [saver] sub *bore* is hardened to at least 50 Rockwell hardness.

15. The apparatus in claim 13, wherein the *tool body* metal sleeve [within the lower end of the tool body] is hardened to at least 50 Rockwell hardness.

* * * * *